US005934942A

United States Patent [19]

Patel et al.

[11] Patent Number: 5,934,942

[45] Date of Patent: Aug. 10, 1999

[54] SHIELDED ELECTRICAL CONNECTOR ASSEMBLY

[75] Inventors: Arvind Patel, Naperville; Gary M. Comstock, LaGrange; Yew Teck Yap, Naperville, all of Ill.

[73] Assignee: Molex Incorporated, Lisle, Ill.

[21] Appl. No.: 09/001,207

[22] Filed: Dec. 30, 1997

[51] Int. Cl.[6] ..... H01R 9/03

[52] U.S. Cl. ..... 439/610; 439/686

[58] Field of Search ..... 439/610, 686, 439/352, 607, 609, 695

[56] References Cited

U.S. PATENT DOCUMENTS

| | | | |
|---|---|---|---|
| 4,484,792 | 11/1984 | Tengler et al. | 339/143 R |
| 4,927,388 | 5/1990 | Gutter | 439/660 |
| 5,417,590 | 5/1995 | Dechelette | 439/607 |
| 5,435,744 | 7/1995 | Derstine et al. | 439/352 |
| 5,518,421 | 5/1996 | Davis | 439/607 |
| 5,580,283 | 12/1996 | O'Sullivan et al. | 439/686 |
| 5,660,558 | 8/1997 | Osanai | 439/607 |
| 5,667,407 | 9/1997 | Frommer et al. | 439/610 |

OTHER PUBLICATIONS

Molex Europe .8mm pitch shielded plug cable assembly Winter, 1996.

Molex/Siemens headset 91060–0103 PCB/Plug Termination Winter, 1996.

*Primary Examiner*—Gary Paumen
*Assistant Examiner*—Antoine Ngandjui
*Attorney, Agent, or Firm*—Stephen Z. Weiss

[57] ABSTRACT

A shielded electrical connector assembly includes a dielectric housing having a module-receiving cavity. A terminal module is inserted into the cavity. A conductive shell is disposed about at least a portion of the housing. The shell includes a locking portion projecting through the housing into a position for engagement with the terminal module to lock the module in the cavity.

13 Claims, 9 Drawing Sheets

SHIELDED ELECTRICAL CONNECTOR ASSEMBLY

FIELD OF THE INVENTION

This invention generally relates to the art of electrical connectors and, particularly, to a shielded electrical connector assembly wherein the shielding shell of the assembly is used to lock a terminal module within the assembly.

BACKGROUND OF THE INVENTION

Generally, an electrical connector assembly includes some form of dielectric or insulating housing which mounts a plurality of conductive electrical terminals. In a shielded connector, a shielding shell substantially surrounds the housing. The shell may be fabricated of stamped and formed sheet metal material, for instance.

In some electrical connector assemblies, the terminals are individually inserted into respective terminal-receiving passages or cavities in the connector housing. Each individual terminal is inserted with minimal forces but can be locked within its respective passage by substantial locking means. In other connector assemblies, a terminal module which includes all of the terminals is inserted into the housing as a subassembly. For instance, the terminals may be overmolded within a dielectric insert. Therefore, all of the terminals are simultaneously inserted into the housing with the insert.

One of the problems with using terminal modules of the character described above, is that it is desirable to be able to insert the module into the connector housing with minimal insertion forces. On the other hand, it is desirable to lock the module within the housing against substantial withdrawal forces. Either expensive extraneous locking structures must be embodied in the connector assembly, or a compromise must be made between the insertion forces and the anti-withdrawal forces. The present invention is directed to solving these problems in a unique system wherein the outer shielding shell of the connector assembly is used to lock the interior terminal module within the connector housing.

SUMMARY OF THE INVENTION

An object, therefore, of the invention is to provide a new and improved shielded electrical connector assembly of the character described.

In the exemplary embodiment of the invention, the connector assembly includes a dielectric housing having a module-receiving cavity. A terminal module is inserted into the cavity. A conductive shell is disposed about at least a portion of the housing. The shell includes a locking portion projecting through the housing into a position for engagement with the terminal module to lock the module in the cavity.

As disclosed herein, the terminal module includes a dielectric insert mounting a plurality of terminals. Preferably, the insert is overmolded about portions of the terminals. The conductive shell is stamped and formed of sheet metal material. The locking portion of the shell is provided by a stamped and formed tab projecting through an opening in the housing and being engageable with the dielectric insert of the terminal module.

The conductive shielding shell is shown herein as comprising a pair of shell halves each having at least one of the locking tabs thereon. In the preferred embodiment, the locking tabs of the pair of shell halves project through the housing generally from opposite sides thereof for securely locking the terminal module on both sides thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
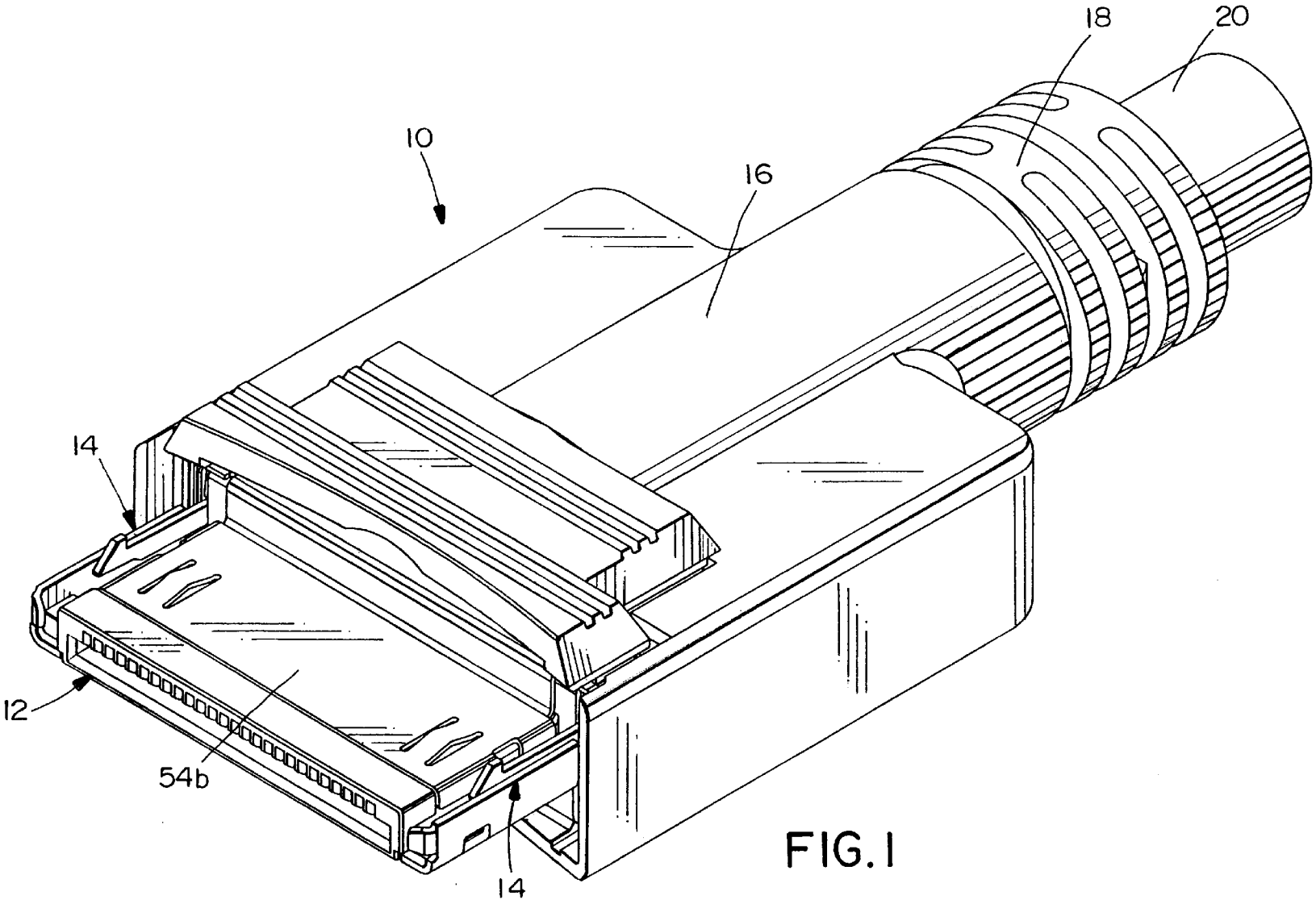
FIG. 1 is a perspective view of an electrical connector assembly embodying the concepts of the present invention.

Referring to the drawings in greater detail, and first to FIG. 1, the invention is embodied in a shielded electrical connector assembly, generally designated 10. The connector assembly is a plug-type connector including a forward mating plug end, generally designated 12, for insertion into a mating receptacle end of a complementary mating connector assembly or other connecting device (not shown). A pair of latches, generally designated 14, are provided for latching the connector assembly to the complementary mating connector assembly. An elastomeric boot 16 substantially surrounds the connector assembly and includes a rearwardly extending strain relief portion 18 which surrounds an electrical cable 20 projecting from the rear of the connector assembly. It should be understood that this type of electrical connector assembly is but one example within which the invention is applicable. The invention can be incorporated in a wide variety of other connector configurations.

Figure 2A:
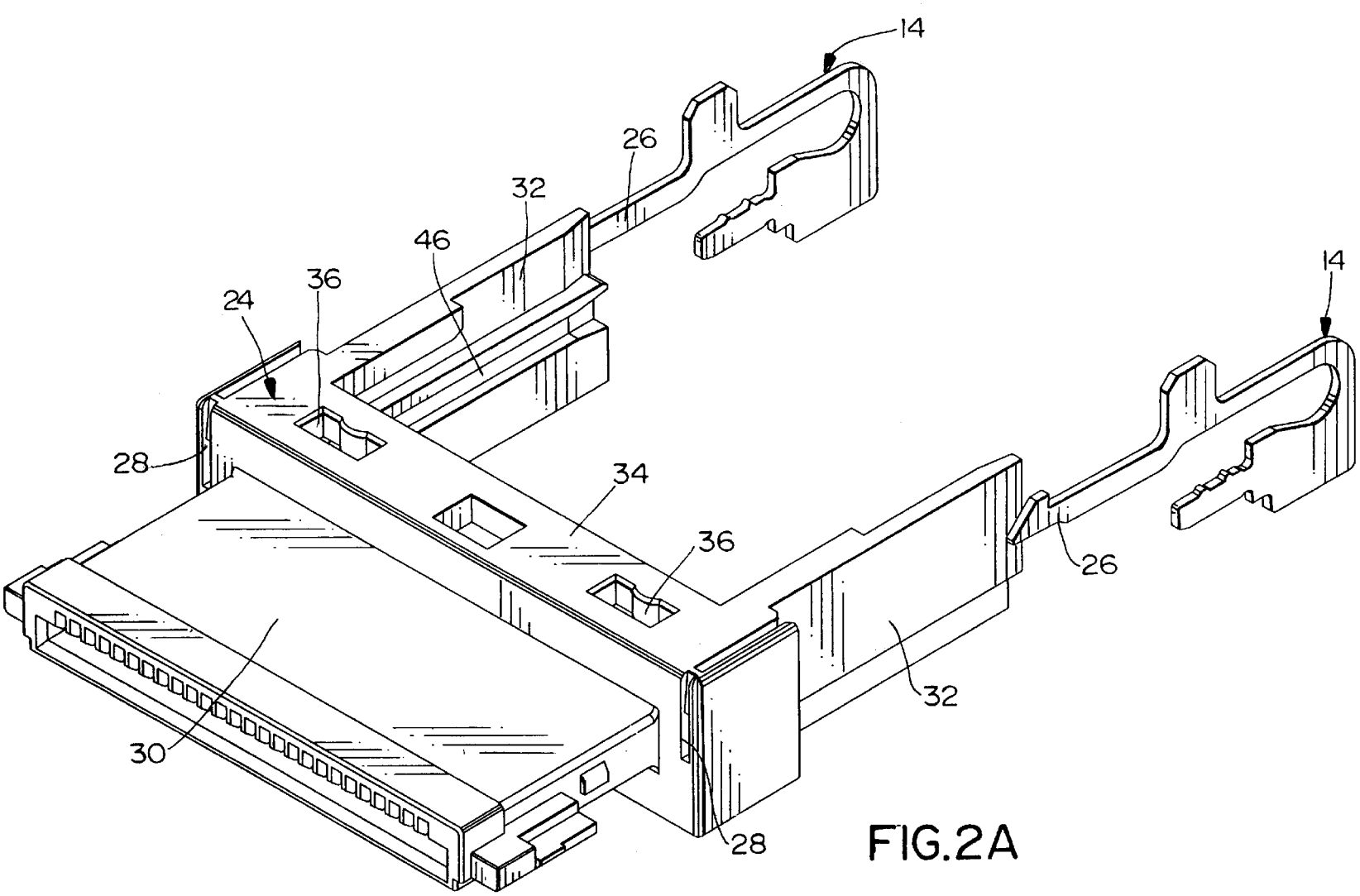
FIGS. 2A–2C are exploded perspective views of the components and assembly of the connector subassembly.
Figure 2B:
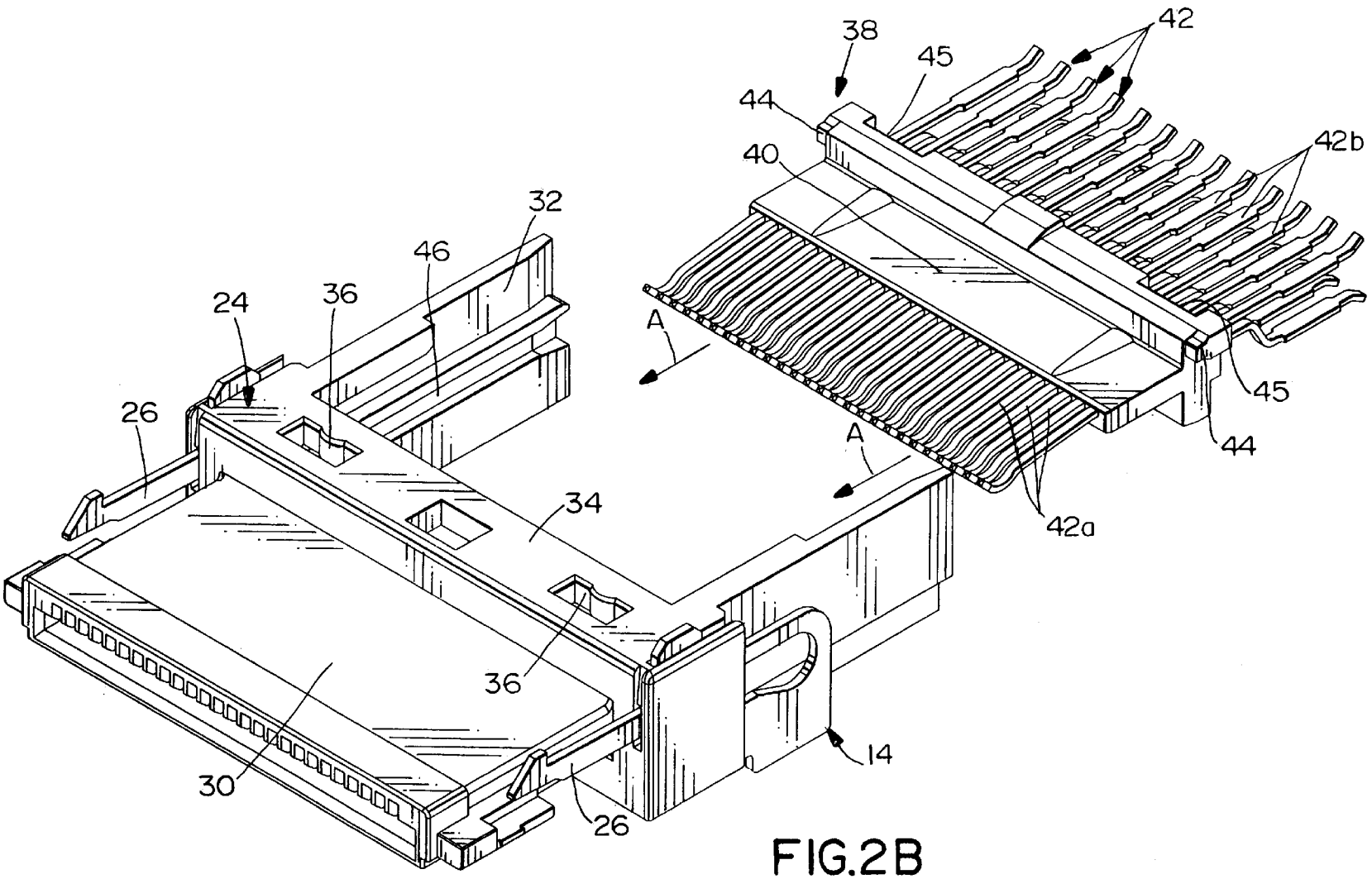
Figure 2C:
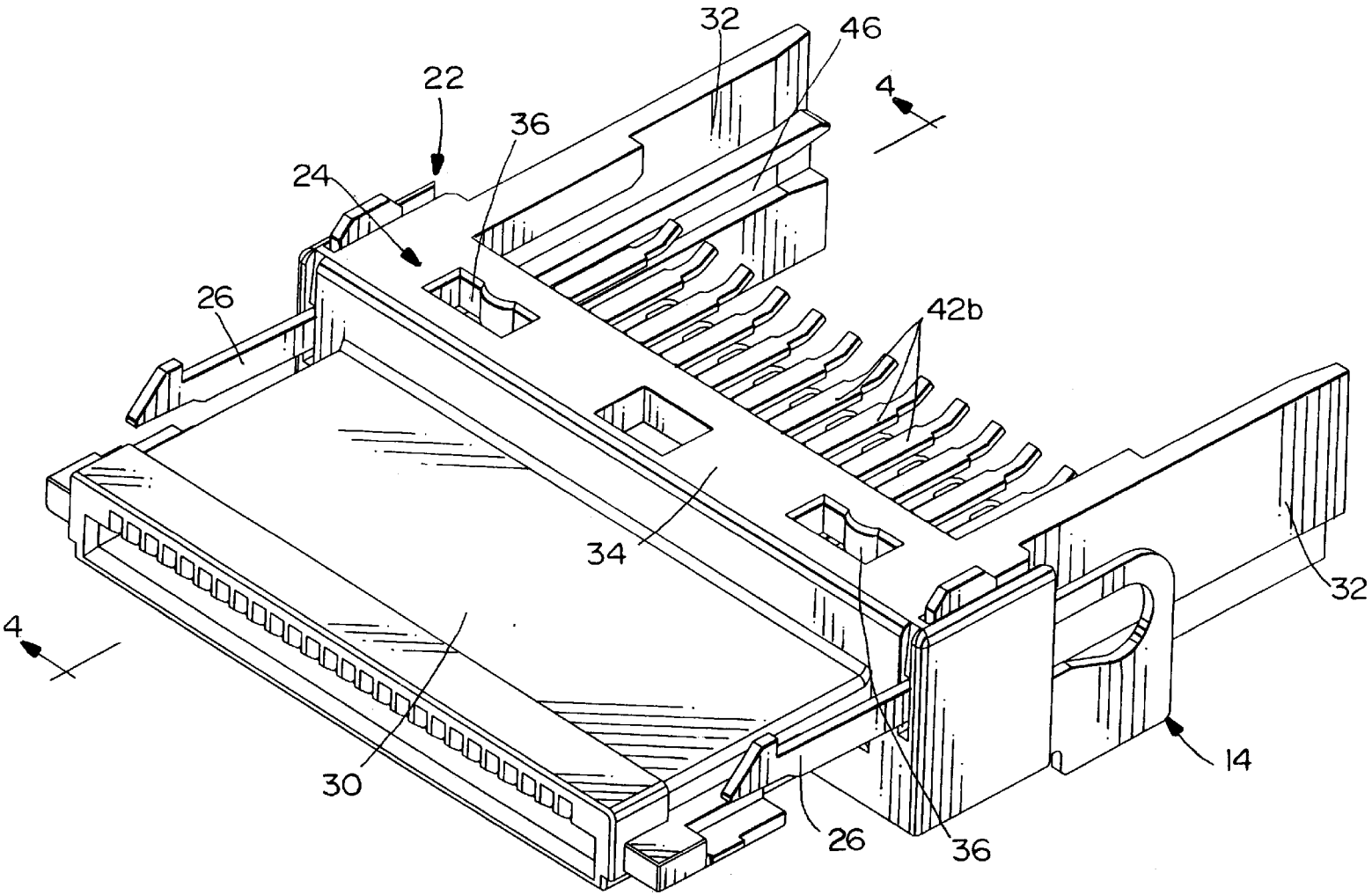

FIGS. 2A–2C show the components and the assembly steps for a connector subassembly, generally designated 22 (FIG. 2C), disposed within connector assembly 10 (FIG. 1). More particularly, connector subassembly 22 includes a dielectric or insulating housing, generally designated 24, which is a one-piece structure unitarily molded of plastic material. Latches 14 are of sheet metal material and have forwardly projecting cantilevered, hooked latch arms 26 which extend through passages 28 in the housing so that the latches project forwardly as seen in FIGS. 1 and 2B for latchingly engaging appropriate latches on the complementary mating connector. The mating plug end 12 (FIG. 1) of the connector assembly is basically defined by a forwardly projecting plug portion 30 of housing 24. The housing has a pair of side wing portions 32 projecting rearwardly thereof. A central body portion 34 of the housing has a pair of openings or windows 36 which open both at the top and bottom of the housing, although only the tops of the openings are visible in FIGS. 2A–2C.

After latches 14 are assembled to housing 24, a terminal module, generally designated 38 is inserted into the rear of the housing as indicated by arrows "A" in FIG. 2B. The terminal module includes a one-piece molded dielectric insert 40 mounting a plurality of terminals, generally designated 42. Preferably, the dielectric insert is overmolded about central portions of the terminals such that cantilevered contact portions 42*a* of the terminals project forwardly of the insert and bifurcated terminating portions 42*b* project rearwardly of the insert. The insert has a pair of ears 44 projecting from opposite sides thereof for riding in a pair of guide channels 46 on the insides of rearwardly projecting wing portions 32 of the housing when the terminal module is inserted into the housing in the direction of arrows "A". The insert also has a pair of recesses 45 in the rear face thereof, both above and below terminating portions 42*b*.

FIG. 2C shows the connector assembly 22 with terminal module 38 (FIG. 2B) fully inserted into the housing. When the terminal module is fully inserted, forwardly projecting contact portions 42*a* of the terminals are disposed within forwardly projecting plug portion 30 of housing 24. Rearwardly projecting terminating portions 42*b* of the terminals project rearwardly of body portion 34 of the housing and are exposed between wing portions 32 of the housing.

Figure 3A:
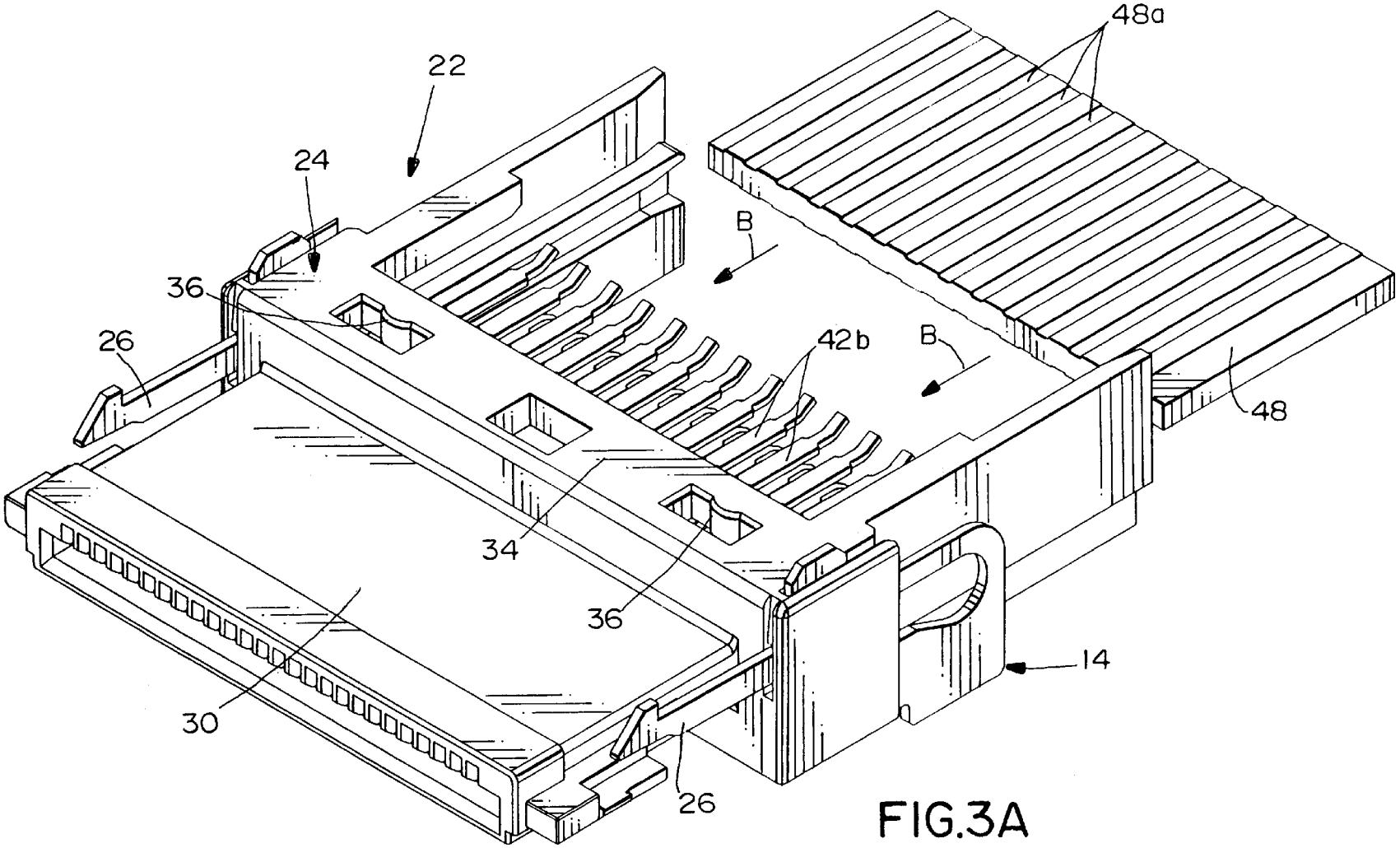
FIGS. 3A–3D are exploded perspective views of the steps in assembling the final connector assembly.

FIGS. 3A–3D show the steps in assembling electrical connector assembly 10 (FIGS. 1 and 3D), starting with connector subassembly 22 (FIGS. 2C and 3A). More particularly, referring to FIG. 3A, after connector subassembly 22 is assembled as described above in relation to FIGS. 2A–2C, a narrow circuit board 48 is inserted in the direction of arrows "B" between bifurcated terminating portions 42*b* of the terminals. The circuit board has a plurality of parallel conductors 48*a* on either one or both of the top and bottom surfaces thereof for engaging terminating portions 42*b* of the terminals.

Figure 3B:
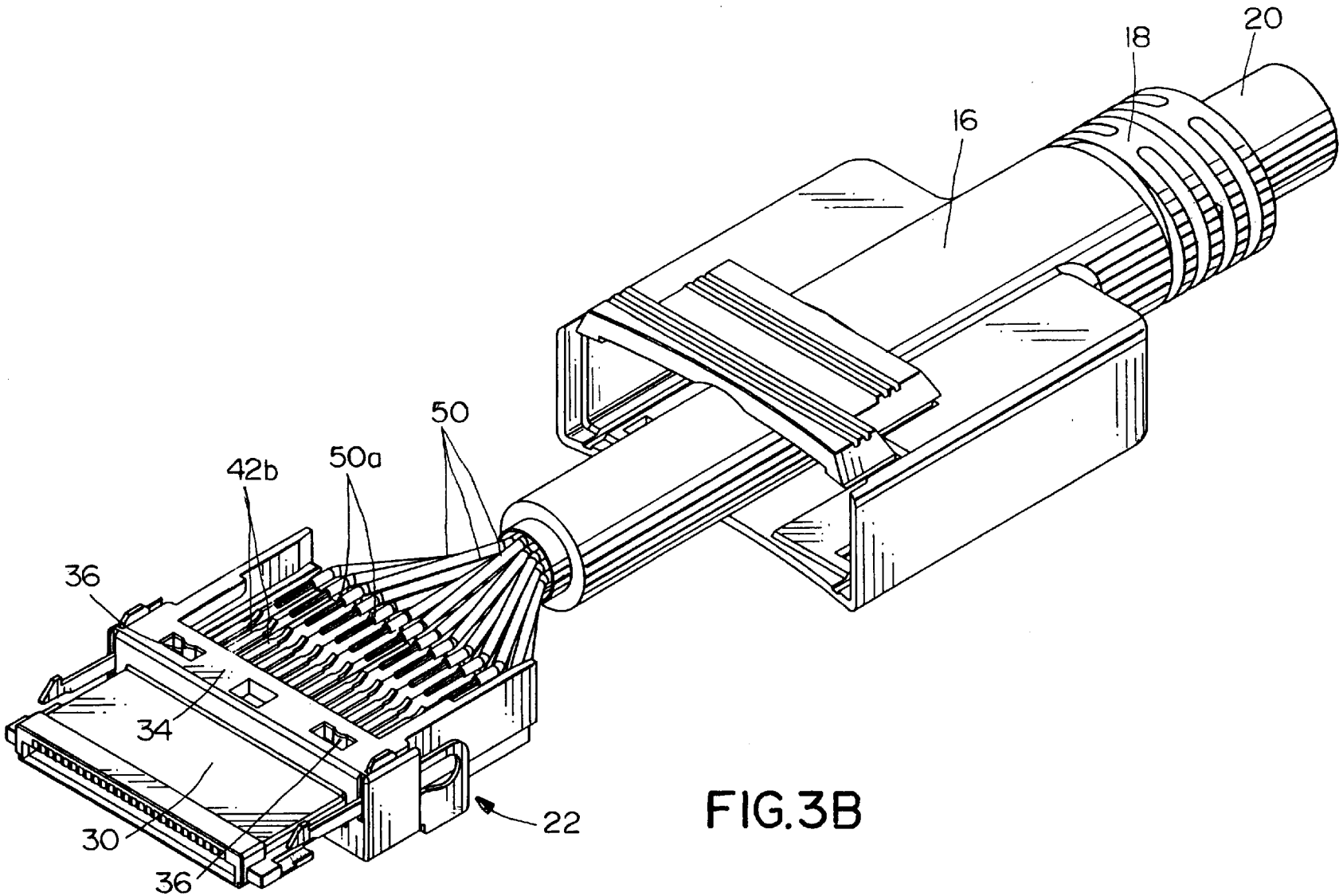

Boot 16 then is threaded onto cable 20 as seen in FIG. 3B. The cable includes a plurality of discrete electrical wires 50. The insulating cladding of the wires is removed to expose lengths of the conductive cores 50*a* of the wires. The cores then are soldered to conductors 48*a* of circuit board 40 to thereby electrically connect the conductive cores of the electrical wires of cable 20 to terminating portions 42*b* of terminals 42 within the connector assembly.

Figure 3C:
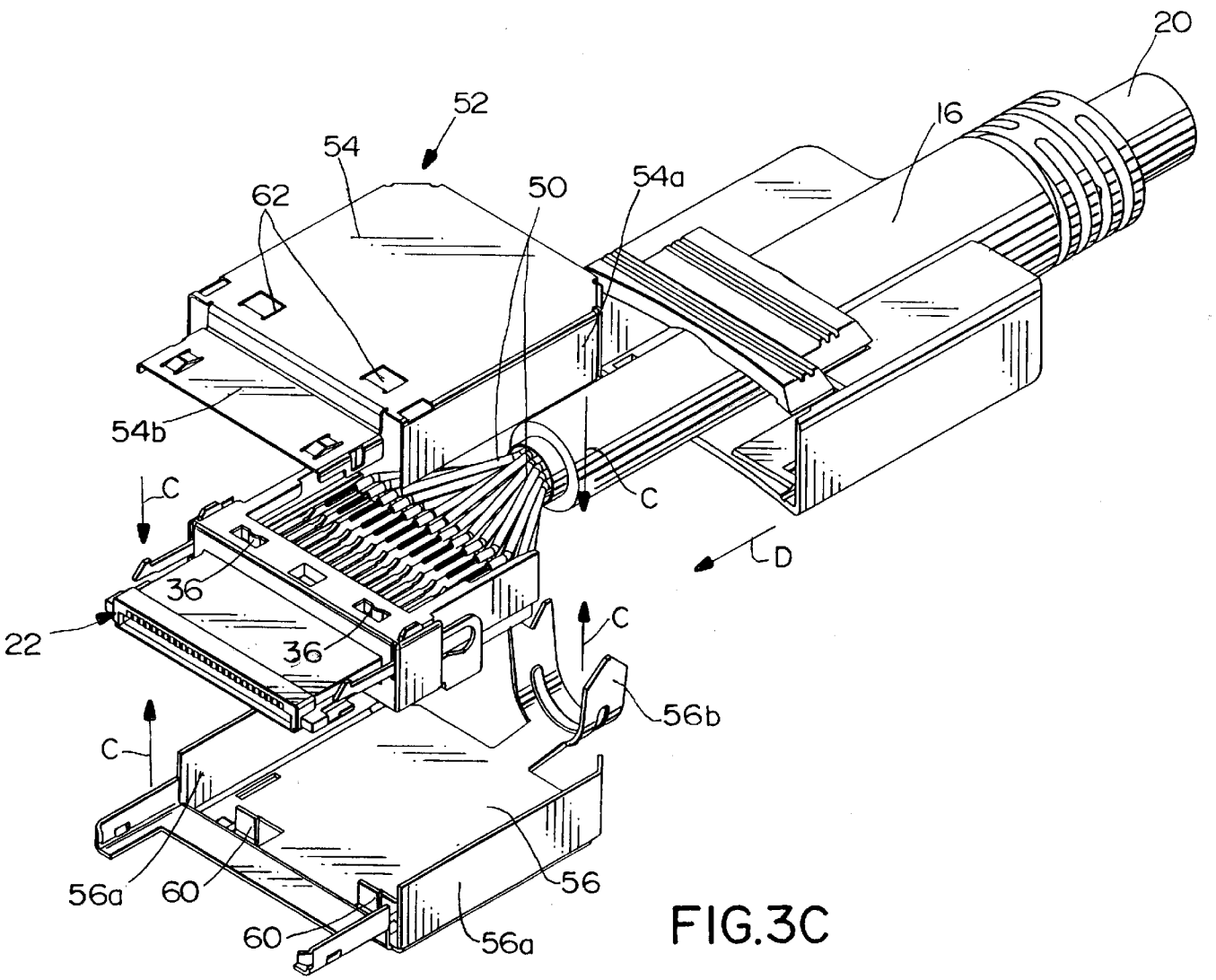

The next assembly step is shown in FIG. 3C wherein a conductive shielding shell, generally designated 52, is assembled about connector subassembly 22 with the electrical wires 50 of cable 20 terminated thereto. More particularly, the conductive shell includes an upper shell half 54 and a lower shell half 56 which have overlapping side walls 54*a* and 56*a*, respectively. Upper shell half 54 has a forwardly projecting plate portion 54*b* which substantially covers the top of forwardly projecting plug portion 30 of the connector housing. Bottom shell half 56 has a rearwardly projecting strain relief clamp 56*b* which is crimped about the outside of cable 20. The shell halves are assembled in the direction of arrows "C" to substantially encase connector subassembly 22 and the entire termination area of electrical wires 50 of cable 20 to portions 42*b* of terminals 42. Each shell half 54 and 56 is a one-piece structure stamped and formed of sheet metal material.

Figure 3D:
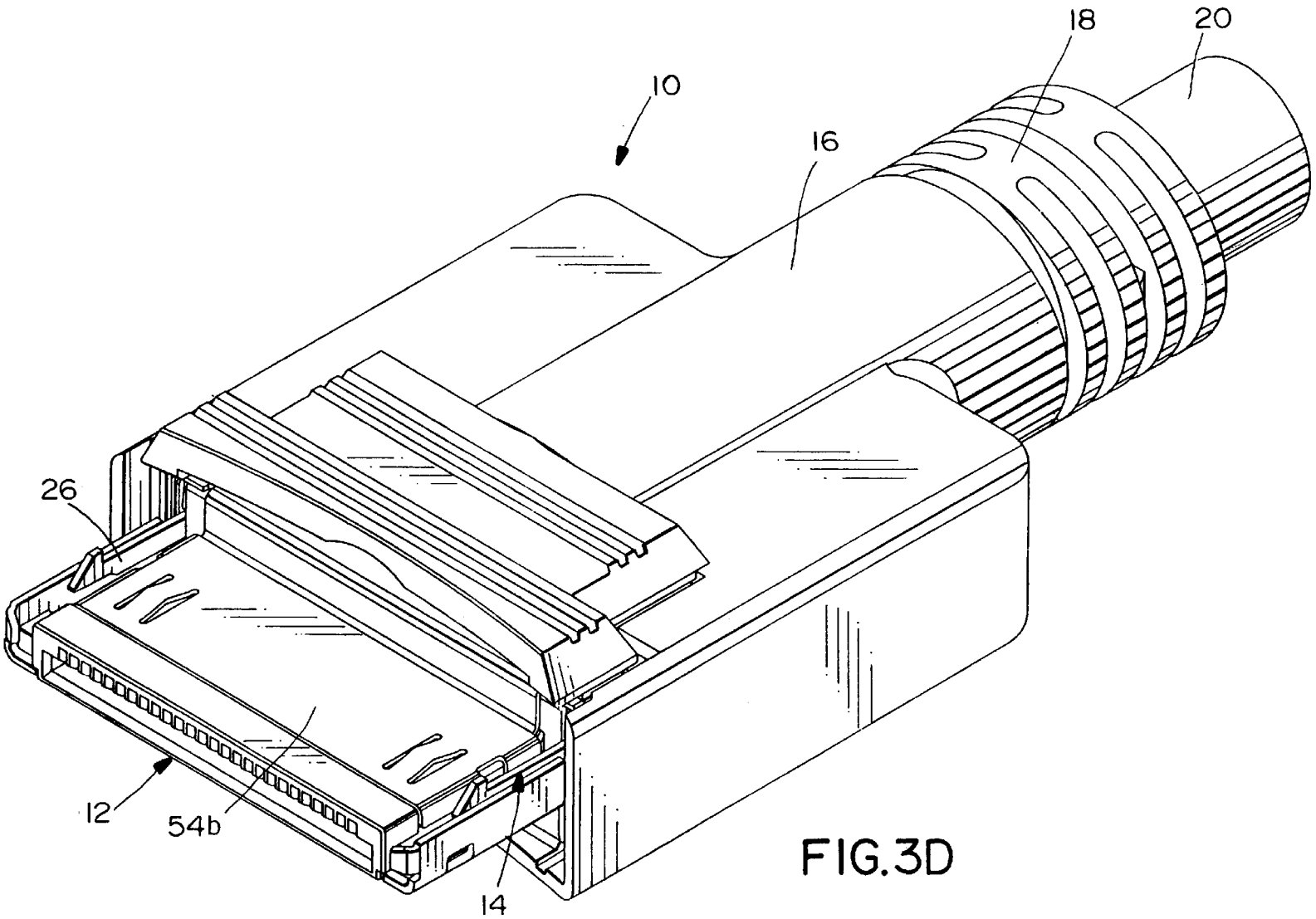

The last assembly step is to move boot 16 in the direction of arrow "D" (FIG. 3C) until the boot substantially surrounds the connector assembly as shown in FIG. 3D which corresponds with FIG. 1 described above. Appropriate latch means (not visible in the drawings) are provided to hold the boot in its assembled condition.

Still referring to FIG. 3C, the invention contemplates that conductive shell 52 on the outside of the connector subassembly 22 includes means for locking terminal module 38 within the subassembly and, therefore, within the overall connector assembly 10. More particularly, each stamped and formed sheet metal shell half 54 and 56 includes a pair of locking tabs 60 (FIG. 3C) stamped and formed out of openings 62 in the shell halves. It can be seen clearly in FIG. 3C how the locking tabs project inwardly (or upwardly) from the inside of lower shell half 56. The same is true for the locking tabs for upper shell half 54, but the tabs are not visible in FIG. 3C. However, the upper shell half clearly shows the openings 62 from which the locking tabs are stamped and formed. The locking tabs are positioned for insertion into openings 36 in the top and bottom of body portion 34 of dielectric housing 24.

Figure 4:
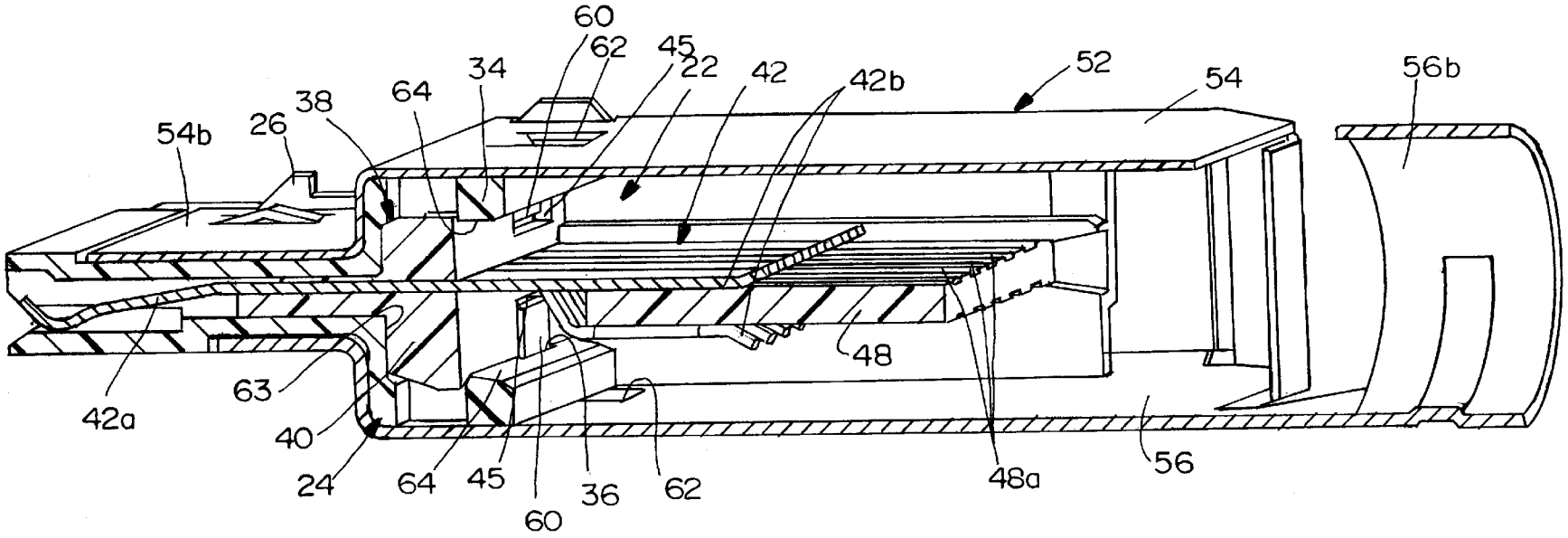
FIG. 4 is a cutaway section taken generally along line 4—4 of FIG. 2C, but with the shell halves assembled onto the connector subassembly.

FIG. 4 shows conductive shell 52, including upper shell half 54 and lower shell half 56 assembled about connector subassembly 22, with terminal module 38 inserted into a cavity 63 in the housing. It can be seen that dielectric insert 40 of the terminal module has been "snapped" past shoulders 64 on the inside of central body portion 34 of housing 24. The clearance between shoulders 64 allows for dielectric insert 40 of the terminal module to be forced therebetween with minimal insertion forces. The clearance is slightly less than the width of the dielectric insert to temporarily hold the terminal module within the housing, i.e. within connector subassembly 22. When shell halves 54 and 56 are assembled about the connector subassembly, locking tabs 60 move through openings 36 in housing 24 and into recesses 45 in the back or rear side of dielectric insert 40. It can be seen clearly in FIG. 4 that locking tabs 60 project inwardly considerably beyond shoulders 64. The locking tabs, being of sufficient size and fabricated of metal material, provide a permanent locking means against substantial withdrawing forces on the terminal module, such as when external pulling forces are applied on cable 20.

From the foregoing, it can be seen that terminal module 38 is assembled within connector subassembly 22 with minimal insertion forces, as dielectric insert 40 of the terminal module moves between shoulders 64 of the connector housing. However, once shell halves 54 and 56 are assembled, locking tabs 60 provide very substantial reaction forces against withdrawal of the terminal module from the connector assembly. Thus, the conductive shell of the connector assembly performs a dual function of shielding the connector assembly as well as locking the terminal module within the assembly.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A shielded electrical connector assembly, comprising:

a dielectric housing having a module-receiving cavity;

a terminal module inserted into said cavity; and a conductive shell about at least a portion of the housing and including a locking portion projecting through the housing into a position for engagement with the terminal module to lock the module in the cavity.

2. The shielded electrical connector assembly of claim 1 wherein said housing includes an opening communicating with said cavity and through which the locking portion of said conductive shell projects.

3. The shielded electrical connector assembly of claim 1 wherein said terminal module includes a dielectric insert mounting a plurality of terminals, said locking portion being engageable with the dielectric insert.

4. The shielded electrical connector assembly of claim 3 wherein the dielectric insert of said terminal module is overmolded about portions of the terminals.

5. The shielded electrical connector assembly of claim 1 wherein said conductive shell is stamped and formed of sheet metal material.

6. The shielded electrical connector assembly of claim 5 wherein said locking portion of the conductive shell comprises a stamped and formed tab projecting through the housing.

7. The shielded electrical connector assembly of claim 1 wherein said conductive shell comprises a pair of shell halves each having at least one of said locking portions.

8. The shielded electrical connector assembly of claim 7 wherein said locking portions project through the housing generally from opposite sides thereof.

9. A shielded electrical connector assembly, comprising:

a dielectric housing having a module-receiving cavity and an opening communicating with the cavity;

a terminal module inserted into said cavity, the module including a dielectric insert mounting a plurality of terminals; and a conductive shell about at least a portion of the housing, the shell being stamped and formed of sheet metal material and including a locking portion projecting through the opening in the housing into a position for engagement with the dielectric insert of the terminal module to lock the module in the cavity.

10. The shielded electrical connector assembly of claim 9 wherein the dielectric insert of said terminal module is overmolded about portions of the terminals.

11. The shielded electrical connector assembly of claim 9 wherein said conductive shell comprises a pair of shell halves each having at least one of said locking portions.

12. The shielded electrical connector assembly of claim 11 wherein said locking portions project through the housing generally from opposite sides thereof.

13. The shielded electrical connector assembly of claim 9 wherein said locking portion of the conductive shell comprises a stamped and formed tab projecting through the opening in the housing.

* * * * *